US008133299B2

(12) United States Patent
Brandon et al.

(10) Patent No.: US 8,133,299 B2
(45) Date of Patent: Mar. 13, 2012

(54) MULTIPLE HEARTH FURNACE FOR REDUCING IRON OXIDE

(75) Inventors: Mark M. Brandon, Charlotte, NC (US); Bradford G. True, Charlotte, NC (US)

(73) Assignee: Nu-Iron Technology, LLC, Charlotte, NC (US)

( * ) Notice: Subject to any disclaimer, the term of this patent is extended or adjusted under 35 U.S.C. 154(b) by 16 days.

(21) Appl. No.: 12/513,872

(22) PCT Filed: Nov. 8, 2007

(86) PCT No.: PCT/US2007/084029

§ 371 (c)(1),
(2), (4) Date: Oct. 12, 2009

(87) PCT Pub. No.: WO2008/063897

PCT Pub. Date: May 29, 2008

(65) Prior Publication Data

US 2010/0031778 A1 Feb. 11, 2010

Related U.S. Application Data

(60) Provisional application No. 60/866,237, filed on Nov. 17, 2006.

(51) Int. Cl.
*C21B 13/10* (2006.01)

(52) U.S. Cl. ..... 75/484; 266/44; 266/178; 266/180; 266/190; 432/128; 432/152

(58) Field of Classification Search ..... 75/484; 266/44, 178, 180, 190; 423/128, 136; 432/128, 432/136

See application file for complete search history.

(56) References Cited

U.S. PATENT DOCUMENTS

| | | | | |
|---|---|---|---|---|
| 4,205,935 | A * | 6/1980 | Edler et al. | 414/152 |
| 6,135,766 | A | 10/2000 | Takeda et al. | |
| 6,257,879 | B1 * | 7/2001 | Lu et al. | 432/121 |
| 6,390,810 | B1 | 5/2002 | Rinker et al. | |
| 3,413,295 | A1 | 7/2002 | Meissner et al. | |
| 6,413,295 | B2 | 7/2002 | Meissner et al. | |
| 2004/0173054 | A1 | 9/2004 | Tsuge et al. | |
| 2005/0229748 | A1 | 10/2005 | Bleifuss et al. | |

OTHER PUBLICATIONS

International Preliminary Reporting on Patentability in PCT/US2007/084029, dated May 28, 2009.
PCT/US2007/084029 International Search Report and Written Opinion dated May 7, 2008.

* cited by examiner

*Primary Examiner* — George Wyszomierski
*Assistant Examiner* — Tima M McGuthry Banks
(74) *Attorney, Agent, or Firm* — Hahn, Loeser & Parks LLP; Arland T. Stein

(57) ABSTRACT

A multiple moving hearth furnace (10) having a furnace housing (11) with at least two moving hearths (20) positioned laterally within the furnace housing, the hearths moving in opposite directions and each moving hearth (20) capable of being charged with at least one layer of iron oxide and carbon bearing material at one end, and being capable of discharging reduced material at the other end. A heat insulating partition (92) is positioned between adjacent moving hearths of at least portions of the conversion zones (13), and is capable of communicating gases between the atmospheres of the conversion zones of adjacent moving hearths. A drying/preheat zone (12), a conversion zone (13), and optionally a cooling zone (15) are sequentially positioned along each moving hearth (30) in the furnace housing (11).

22 Claims, 7 Drawing Sheets

MULTIPLE HEARTH FURNACE FOR REDUCING IRON OXIDE

CROSS-REFERENCE TO RELATED APPLICATIONS

This application is a U.S. national stage application of International Application No. PCT/US2007/084029, filed Nov. 8, 2007, which claims priority from and the benefit of U.S. Provisional Application No. 60/866,237, filed Nov. 17, 2006. The disclosures of both applications are incorporated in their entirety herein by reference.

GOVERNMENT INTERESTS

The present invention was made with support by the Economic Development Administration, Grant No. 06-69-04501, and the Department of Energy, Sponsor Award DE-FG36-05G015185. The United States government may have certain rights in the invention.

BACKGROUND OF THE INVENTION

This invention relates generally to a system and method for producing metallic iron by thermally reducing an iron oxide with a carbon bearing reductant in a moving hearth furnace.

Many different iron ore reduction processes and furnaces have been described and/or used in the past. These processes may be traditionally classified into direct reduction processes and smelting reduction processes. Generally, direct reduction processes convert iron ores into a metallic form with, for example, use of shaft furnaces (e.g., natural gas-based shaft furnaces), whereas smelting reduction converts iron ores into molten hot metal without the use of blast furnaces. The shaft furnace processes include the Midrex® process where an iron oxide source is reduced in a furnace by blowing a reducing gas, e.g., a natural gas, through a tuyere disposed at a lower portion of the shaft furnace. A SL/RN process is another example of a direct iron making process. In the SL/RN process, a carbon bearing material such as coal is used as the reducing agent, and the carbon material is heated together with the iron oxide source, e.g., iron ores, in a rotary kiln to reduce the iron oxide source.

The conventional reduction processes for production of direct reduced iron (DRI) involve heating beneficiated iron ores to below the melting point of iron, below 1200° C. (2372° F.), either by gas-based processes or coal-based processes. For example, in the gas-based process, direct reduction of iron oxide (e.g., iron ores or iron oxide pellets) employs the use of a reducing gas (e.g., reformed natural gas) to reduce the iron oxide and obtain DRI. Methods of making DRI have employed the use of materials that include carbon such as coal and coke as a reducing agent. A typical composition of DRI is 90 to 95% metallization and 2-4% gangue, but has not been practical for use in steelmaking processes as a replacement of scrap because its oxygen and gangue content increases energy usage, increase slag volume, and necessitates the addition of costly reagents.

Natural gas-based direct reduced iron accounts for over 90% of the world's production of DRI. Coal-based processes are generally used in producing the remaining DRI production. However, in many geographical regions, the use of coal may be more desirable because coal prices may be more stable than natural gas prices. Further, many geographical regions are far away from steel mills that use the processed product.

Another gas-based or coal-based reduction process for directly reducing iron bearing material to metallic nodules is often referred to as fusion reduction. Such fusion reduction processes, for example, generally involve the following processing steps: feed preparation, drying, preheating, reduction, fusion/melting, cooling, product discharge, and metallic iron/slag product separation. These processes result in direct reduction of iron bearing material to metallic iron nodules and slag. Metallic iron nodules produced by these direct reduction processes are characterized by high grade reduction, nearing 100% metal (e.g., about 96% to about 97% metallic Fe).[1]

[1]Percents (%) herein are percents by weight unless otherwise stated.

Unlike conventional direct reduced iron (DRI), these metallic iron nodules have low oxygen content because they are metallic iron and have little or no porosity. These metallic iron nodules are also low in gangue because silicon dioxide has been removed as slag. Such metallic iron nodules are desirable in many circumstances such as use in place of scrap in electric arc furnaces. These metallic iron nodules can be also produced from beneficiated taconite iron ore, which may contain 30% oxygen and 5% gangue. As a result, with such metallic iron nodules, there is less volume to transport than with beneficiated taconite pellets or DRI. In addition, generally, such metallic iron nodules are just as easy to handle as taconite pellets and DRI.

Various types of hearth furnaces have been described and used for direct reduction of metallic iron nodules. One type of hearth furnace, referred to as a rotary hearth furnace (RHF), has been used as a furnace for coal-based direct reduction. An example of such a rotary hearth furnace is described in U.S. Pat. No. 3,443,931. Another type is the linear hearth furnace such as described in US 2005/229748.

Both the rotary hearth furnace and the linear hearth furnace involve making mixtures of carbon bearing material with iron ore or other iron oxide fines into balls, briquettes or other compacts, and heating them on a moving hearth furnace to reduce the iron oxide to metallic iron nodules and slag. Typically, both the rotary and linear hearth furnaces are partitioned into a preheating zone, a reduction zone, a fusion zone, and a cooling zone, between the supply location and the discharge location of the furnace. In operation, raw reducible material comprising a mixture of iron ore and reducing material is charged onto the moving hearth and moved into the preheat zone where the raw materials are dried and preheated. After preheating, the iron ore mixture on the hearth is moved to the reduction zone where the iron ore is reduced in the presence of the reducing material and fused into metallic iron nodules, using one or more heat sources (e.g., gas burners). The reduced and fused product, after completion of the reduction process, is cooled in the cooling zone on the moving hearth, preventing oxidation and facilitating discharge from the furnace.

A limitation of these furnaces, and the methods of operating these furnaces, in the past has been their energy efficiency. The iron oxide bearing material and associated carbon bearing material generally had to be heated in the furnace to about 2500° F. (1370° C.), or higher, to reduce the iron oxide and produce metallic iron material. The furnace generally required natural gas or coal to be burned to produce the heat necessary to heat the iron oxide bearing material and associated carbon bearing material to the high temperatures to reduce the iron oxide and produce a metallic iron material. Furthermore, the reduction process involved production of volatiles in the furnace that had to remove from the furnace and secondarily combusted to avoid an environmental hazard, which added to the energy needs to perform the iron reduction. See, e.g., U.S. Pat. No. 6,390,810.

What has been needed is a furnace that reduces the energy consumption needed to reduce the iron oxide bearing material such that a large part, if not all, of the energy to heat the iron oxide bearing source to the temperature necessary to cause the iron oxide to be reduced to metallic iron and slag comes from combusting volatiles directly in the furnace itself, and otherwise using heat generated in one part of the furnace in another part of the furnace. Such a furnace is described in Provisional Application Ser. No. 60/828,170, filed Oct. 4, 2006, which is incorporated herein by reference. Still there is a need for a furnace that has a higher production capacity, is more efficient in transferring fluids between different parts of the furnace, and has a lower capital and operating cost for a given production capacity.

SUMMARY OF THE INVENTION

A multiple hearth furnace is disclosed comprising:

a. a furnace housing having at least two moving hearths positioned laterally within the furnace housing, at least two of said hearths moving in opposite directions and each moving hearth capable of being charged with at least one layer of iron oxide source and carbon bearing material adjacent one end of the furnace housing, and being capable of discharging reduced material adjacent the other end of the furnace housing, b. each moving hearth capable of passing within the furnace housing sequentially through a drying/preheat zone providing an atmosphere capable of drying an iron oxide source and carbon bearing material, a conversion zone providing an atmosphere capable of fluidizing volatile material in the iron oxide source and at least partially reducing iron oxide, and, optionally, a cooling zone capable of providing a cooling atmosphere for cooling reduced material containing metallic iron on the moving hearth positioned within the furnace housing, c. a heat insulating partition positioned between adjacent moving hearths in at least portions of the conversion zones at least partially separating the atmospheres adjacent opposite sides of the partition, and d. at least one communication passageway capable of transferring fluid between the atmospheres of the conversion zones of moving hearths moving in opposite directions within the furnace housing.

Heat insulating partitions may also be provided between drying/preheating zones and cooling zones of adjacent moving hearths. These heat insulating partitions may be an extension of the heat insulating partition between conversion zones of adjacent moving hearths.

A separation barrier may be positioned in at least a portion of the conversion zone of each moving hearth separating the conversion zone into a combustion region and a reducing region, with the reducing region adjacent the moving hearth and the combustion region adjacent the reducing region and spaced from the moving hearth. In each moving hearth, fluidized volatiles produced by heating the iron oxide source and carbon bearing material in the reducing region of a conversion zone are transferred through at least one passageway to the combustion region of the conversion zone of a moving hearth within the furnace housing moving in the opposite direction, where the fluidized volatiles may be combusted to heat and at least partially reduce iron oxide on the moving hearth in the adjacent reducing region of the conversion zone without inhibiting contact of the combusted fluid with the iron oxide source in the reducing region.

Adjacent the conversion zone in each moving hearth, and before the cooling zone if present, may be a fusion zone providing an atmosphere capable of fusing iron oxide on each moving hearth into metallic iron nodules. Fluids produced in the fusion zone of one moving hearth may be transferred through at least one passageway to the combustion region of the conversion zone of a hearth moving in the opposite direction, where the fluids may be combusted to heat and at least partially reduce iron oxide and carbon bearing material on the moving hearth in the adjacent reducing region of the conversion zone without inhibiting contact of the combusted fluid with the iron oxide source in the reducing region.

The multiple hearth furnace may also have a circulation system capable of circulating fluids between the atmospheres of the cooling zone of a moving hearth, and the drying/preheat zone of an adjacent moving hearths moving in an opposite direction within the furnace housing. These moving hearths moving in opposite directions may be positioned adjacent each other with only the heat insulating partition between them. In any event, at least one passageway may be provided capable of transferring fluids between the atmospheres of the drying/preheating and cooling zones of moving hearths moving in opposite directions within the furnace housing. Each moving hearth may be a continuous belt or be comprised of removable sections or hearth cars positioned end-to-end. The multiple hearth furnace may also have a drive system capable of causing each moving hearth to move through the furnace housing from a charging end to a discharging end of the furnace. The drive system may be hydraulic, pneumatic, gear or any other suitable drive.

Also, the multiple hearth furnace may have a maintenance apparatus capable of receiving removable hearth sections from either end of the furnace housing, and capable of returning removable hearth sections to either end of the furnace housing.

Further, a method of reducing an iron oxide source is disclosed comprising:

providing a furnace housing having at least two moving hearths positioned laterally therein, where the moving hearths are formed of a plurality of removable hearth sections that move through the furnace housing, causing in each moving hearth within the furnace housing, hearth sections to sequentially move through a drying/preheat zone providing an atmosphere capable of drying an iron oxide source and carbon bearing material, a conversion zone providing an atmosphere capable of fluidizing volatile material in the iron oxide source and carbon bearing material and at least partially reduce iron oxide in the iron oxide source, and, optionally, a cooling zone capable of providing a cooling atmosphere for cooling reduced iron and carbon bearing material on the moving hearth within the furnace housing, providing a heat insulating partition positioned between the adjacent moving hearths in at least a portion of the conversion zones to at least partially separate the atmospheres on opposite sides of the partition, charging at least one layer of iron oxide source and carbon bearing material to the moving hearth sections at one end of each moving hearth, moving the charged iron oxide source and carbon bearing material on removable hearth sections as at least two separate hearths moving through the furnace housing in opposite directions, drying and preheating the charged iron oxide source and carbon bearing material on the removable hearth sections in the drying/preheating zone of each moving hearth, fluidizing volatiles from the charged iron oxide source and carbon bearing material on the moving hearth sections of each moving hearth in the conversion zone within the furnace housing, transferring fluidized volatiles from the atmosphere of the conversion zone of one moving hearth to the atmosphere of the conversion zone of a moving hearth moving in the opposite direction within the furnace housing, combusting the transferred fluidized volatiles within the conversion zone of a moving hearth moving in the opposite direction within the furnace housing to heat the iron oxide source and carbon bearing material on removable hearth sections moving through the conversion zone, and optionally cooling the reduced iron on the removable hearth sections in a cooling zone of the moving hearth.

The method may be used to produce metallic iron nodules and slag by positioning, in each moving hearth within the furnace housing, a fusion zone providing an atmosphere capable of at least partially fusing reduced iron into metallic iron nodules adjacent the conversion zone and before the cooling zone, if provided. Alternatively, the method may be used to produce DRI material, which contain metallic iron and typically between 2% and 4% gangue.

The method may further comprise the step of circulating gas between the atmospheres of a cooling zone of a moving hearth and a drying/preheat zone of an adjacent moving hearth within the furnace housing.

The method of producing iron from iron oxide may further comprise transferring a selected removable hearth section from either end of the moving hearth to a maintenance track, and transferring the selected removable hearth section from the maintenance track back to either end of the moving hearth.

The foregoing and other aspects will become apparent from the following detailed description of the invention when considered in conjunction with the accompanying drawings.

DETAILED DESCRIPTION OF SOME EMBODIMENTS

Shown in the FIGURES is a multiple moving hearth furnace 10. At least two moving hearths 20 are positioned laterally to one another within furnace housing 11 of furnace 10. The drawings show embodiments with two moving hearths 20 positioned laterally adjacent each other within furnace housing 11, and moving in opposite directions through furnace housing 11. However, the multiple hearth moving hearth furnace 10 can include any number of similar moving hearths 20, and may or may not be in multiples of two.

Figure 1:
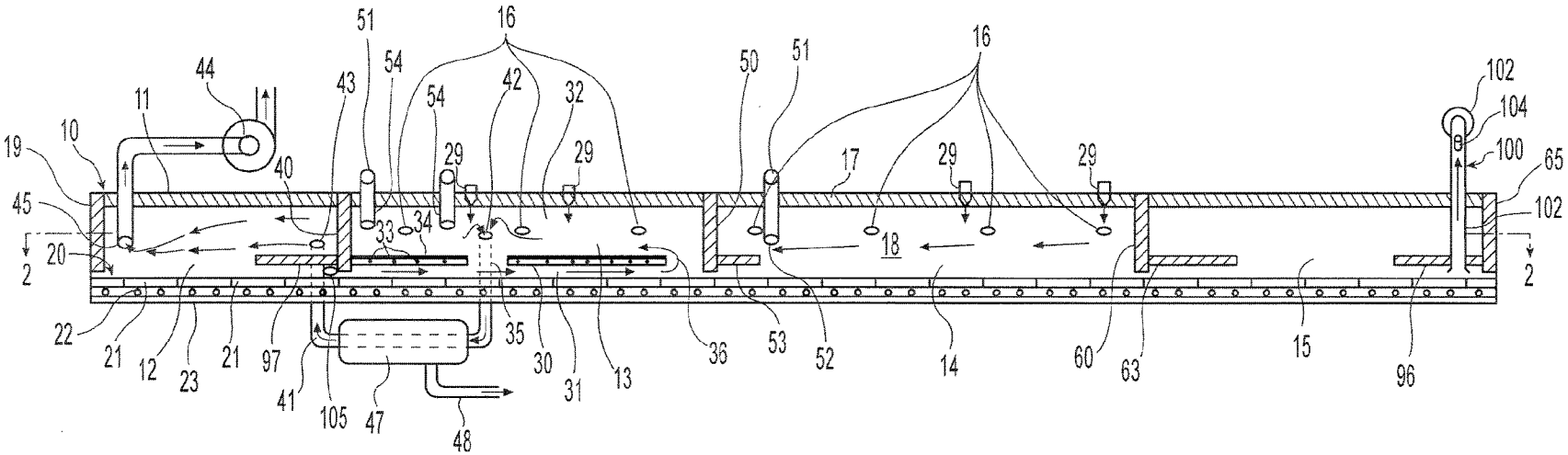
FIG. 1 is an elevation view illustrating a multiple moving hearth furnace for producing metallic iron material.

Referring to FIG. 1, a hearth furnace 10 is shown for producing metallic iron nodules directly from iron ore and other iron oxide sources. Alternatively, the furnace 10 may be used to produce DRI. The furnace 10 has a furnace housing 11 internally lined with a refractory material suitable to withstand the temperatures involved in the direct reduction process carried out in the furnace. Each moving hearth 20 in furnace housing 11 of hearth furnace 10 is divided into a drying/preheat zone 12 capable of providing a drying/preheating atmosphere for reducible material, a conversion zone 13 capable of providing a reducing atmosphere for at least partially reducing reducible material, a fusion zone 14 capable of providing an atmosphere to at least partially form metallic iron nodules, and optionally a cooling zone 15 capable of providing a cooling atmosphere for reduced material containing metallic iron material.

The conversion zone 13 is positioned between the drying/preheat zone 12 and the fusion zone 14. The conversion zone 13 is the zone in which volatiles from the reducible material, including carbon bearing material, is fluidized, as well as the zone in which at least the initial reduction of reducible iron oxide material occurs. The entry end of each moving hearth 20, at the drying/preheat zone 12, is closed by a restricting baffle 19 that inhibits fluid flow between the outside ambient atmosphere and the atmosphere of the drying/preheat zone 12, yet provides clearance so as not to inhibit the movement of reducible material into the furnace housing 11. The baffle 19 may be made of suitable refractory material or a metal material if the temperatures are sufficiently low.

Each moving hearth 20 may be a plurality of removable hearth sections or cars 21 positioned to move through the furnace housing 11 as part of the moving hearth as shown in FIG. 1. Hearth cars 21 are moved on wheels 22, which typically engage railroad rails 23. The upper portion of the hearth cars 21 are lined with a refractory material suitable to withstand the temperatures for reduction of the iron oxide bearing material into metallic iron as explained herein. The removable hearth cars 21 are positioned contiguously end to end to move through the furnace housing 11, and curb 24 with a sand seal 25 are positioned along opposite sides of each hearth car 21. The curbs 24 are shaped to move in refractory portions 26 on the opposite sides of each moving hearth 20. The sand seal is comprised of trough 27 containing sand in the furnace housing 11 on opposite sides of each moving hearth 20, and knife seal 28 extending downwardly from opposite sides of each hearth car 21 to engage the sand in the trough 27 as the hearth car moves through the furnace housing 11, as part of moving hearth 20. By this assembly, the lower portions of the furnace housing 11 and the lower portions of the hearth cars 21 are protected from damage from the heat generated in the furnace 10 as the process of reducing iron oxide-bearing material into metallic iron proceeds. Alternatively, each moving hearth 20 may be a movement belt or other suitable conveyance medium that, with the refractory material described below, is able to within the high temperatures of the furnace atmospheres as described below.

Figure 2:
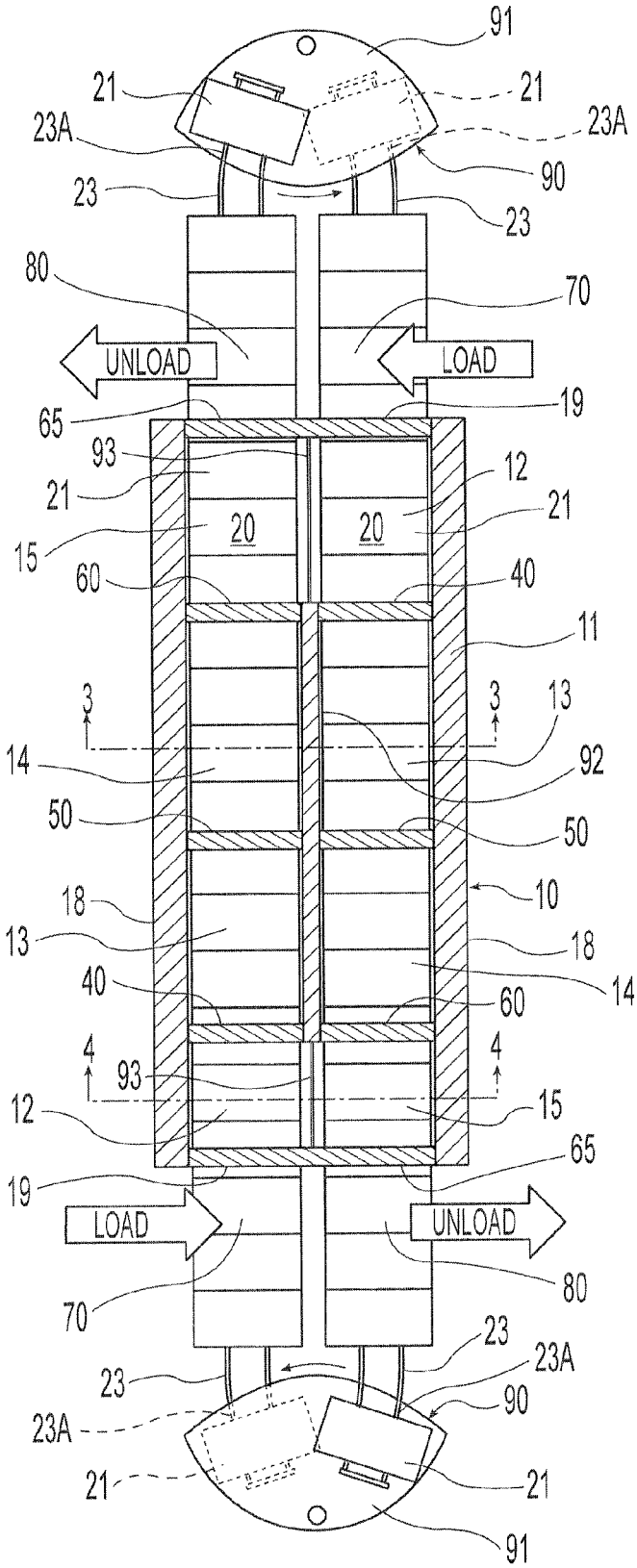
FIG. 2 is a plan view illustrating a multiple moving hearth furnace taken along line 2-2 of FIG. 1 with horizontal baffles not shown for clarity.
Figure 3:
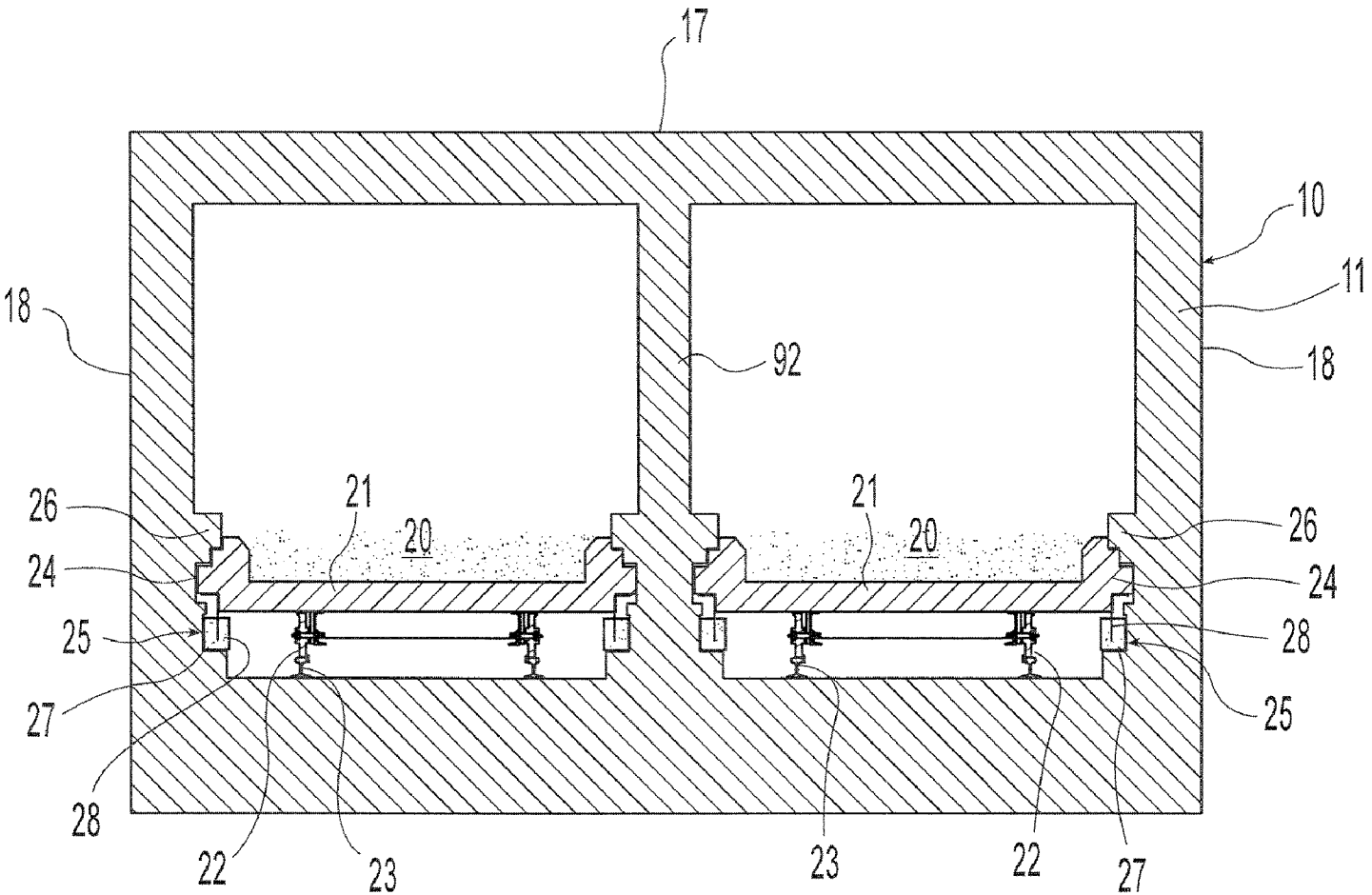
FIG. 3 is a cross-sectional view taken on line 3-3 of FIG. 2.

One end of each moving hearth 20 is a charging end 70 and the other end is a discharging end 80. The charging end 70 of one moving hearth 20 may be positioned adjacent the discharging end 80 of an adjacent moving hearth 20 as shown in FIG. 2. Outside the furnace housing 11 at the charging ends 70 of each moving hearth 20, the reducible material is positioned on the hearth cars 21 by a charging system (not shown) generally in the form of a mixture of finely divided iron ore, or other iron oxide bearing material, and a carbon bearing material, such as coke, char, anthracite coal or non-caking bituminous and sub-bituminous coal. The reducible material is in mixtures of finely divided iron oxide-bearing material that are formed into compacts. The compacts may be preformed as briquettes or balls, or formed in situ as mounds on the hearth cars 21 so that the mixtures of reducible material are presented in discrete portions on the hearth cars 21 in each moving hearth 20. Also, a hearth layer of finely divided carbon bearing material, such as coke, char or coal, may be provided on the hearth cars 21, with the reducible material positioned on the hearth layer, to avoid damage to the refractory material forming the upper portion of the hearth cars 21 from the slag generated on reducing the metallic iron in the furnace.

Each moving hearth 20 in furnace housing 11 may be linear as generally illustrated in FIG. 1. In this connection, the building in which the furnace is housed, or other considerations, may require that certain parts of the furnace be arcuate or at angles, to accommodate these needs. For these purposes, the hearth furnace is classified as linear if a part of its length, usually the conversion zone 13, is substantially linear in the direction of travel of each moving hearth 20.

The zones of each moving hearth 20 are generally characterized by the temperature reached in each zone. In the drying/preheat zone, moisture is generally driven off from the reducible material and the reducible material is heated to a temperature short of substantial fluidizing of volatiles in and associated with the reducible material positioned on the hearth cars 21. The design is to reach in the drying/preheat atmosphere a cut-off temperature in the reducible material just short of significant volatilization of carbon bearing material in and associated with the reducible material. This temperature is generally somewhere in the range of about 300-600° F. (150-315° C.), depending in part on the particular composition of the reducible material.

The conversion zone 13 of each moving hearth 20 is characterized by heating the reducible material first to drive off remaining moisture and a majority of the volatiles in the reducible material, and then to initiate the reduction process in forming the reducible material into metallic iron material and slag. The conversion zone 13 is generally characterized by heating the reducible material to about 1500 to 2100° F. (815 to 1150° C.), depending on the particular composition and form of reducible material.

The fusion zone 14 of each moving hearth 20 involves further heating the reducible material, now absent a majority of volatile materials and commencing reduction of reducible iron oxide, to fuse into metallic iron nodules and slag. The fusion zone generally involves heating the reducible material to about 2400 to 2550° F. (1315-1400° C.), or higher, so that metallic iron nodules are formed with only a low percentage of iron oxide in the metallic iron. If the process is carried out efficiently, there will also be a low percentage of iron oxide in the slag, since the process is designed to reduce very high percentage of the iron oxide in the reducible material to metallic iron.

The heating of the reducible material in the conversion zone 13 and fusion zone 14 of each moving heath 20 may be done by oxy-fuel burners 16 in the roof 17 and/or side wall 18 of the furnace housing 11 adjacent each moving hearth 20. The oxy-fuel burners 16 may be positioned on about 10 foot centers (about 3 m), along outside side walls 18, about a foot down from the roof 17 of the furnace housing 11. Alternatively, or in addition, the oxy-fuel burners may be positioned in the roof 17 of the furnace housing 11 at each moving hearth 20. In any case, the oxy-fuel burners 16 are positioned to provide for efficient combustion of the fluidized volatile materials in the conversion zone (as described in detail below) and to efficiently reduce the reducible material to metallic iron nodules in fusion zone 14. The oxy-fuel burners 16 should be positioned to provide for efficient heat transfer and efficient reduction of the iron oxide in the reducible material in each moving hearth 20 with the least energy consumption. In addition, oxygen lances 29 may be positioned in the roof 17 of the furnace housing 11 of the conversion zone 13 and the fusion zone 14 to provide additional energy for generation of heat and reduction conversion into metallic iron nodules in the furnace.

In each moving hearth 20, the metallic iron material is cooled in cooling zone 15 from its formation temperature in the conversion zone 13 and/or fusion zone 14 to a temperature at which the metallic iron material can be reasonably handled and further processed. This temperature is generally below 800° F. (425° C.) and more typically about 550° F. (290° C.) or below. Water spray may be used for the cooling in or beyond the cooling zone 15, if desired, where provision made for water handling in the system. Typically, the temperature of the material on the moving hearth 20 after cooling in, and after the cooling zone 15, is about 300 to 600° F. (150-315° C.) depending on the design of the cooling system.

Shown in FIG. 1, a separation barrier 30 may be positioned in the conversion zone 13 in each moving hearth 20, separating the conversion zone into reducing region 31 adjacent the moving hearth 20 and combustion region 32 adjacent the reducing region 31 and spaced from the moving hearth 20. In one embodiment, the separation barrier 30 may be comprised of closed spaced pipes 33, e.g., 2 foot on centers (about 0.6 m), positioned transverse between side walls 18 at each moving hearth 20, and supporting a plate or grate 34 as shown in FIG. 1. The plate or grate 34 may be made of silicon carbide or another suitable refractory ceramic material. Separation barrier 30 may also have intermediately along its length and at its end gaps 35 and 36, respectively. The gaps are typically positioned to facilitate flow of the fluidized volatile material from the reducible material in the reducing region 31 to the combustion region 32 of the conversion zone 13, for efficient combustion of the volatiles to produce heat that can be transferred to the reducing region 31 and reducible material in the reducing region 31 of the conversion zone 13 of each moving hearth 20. To provide for this flow from the reducing region 31 to the combustion region 32 in each moving hearth 20, a fluid flow is created through the atmosphere of the reducing region 31 in the direction of travel of each moving hearth 20, and in a part of the combustion region 32, in a direction counter to the direction of movement of each moving hearth 20 through the furnace housing 11.

Alternatively, or in addition to gaps 35 and 36, the separation barrier 30 may be perforated, as with a grate for example, or otherwise discontinuous to allow for efficient flow of fluidized volatile material from the reducing region 31 into the combustion region 32 of the conversion zone 13. To provide for efficient flow of the volatile material fluidized in the reducing region 31 into the combustion region 32 of the conversion zone 13, the separation barrier 30 may also ascend upwardly in the direction of movement of the hearth 20 through the furnace 10. Such an ascending separation barrier 30 where the separation barrier is angled as described in application Ser. No. 60/828,170, filed Oct. 4, 2006, which is incorporated herein by reference. Alternatively, the separation barrier 30 may be provided in ascending steps to facilitate construction of an ascending separation barrier 30 in sections along the furnace housing 11. In any case, the separation barrier is ascending to allow for increased volume of fluidized volatile material in the reducing region 31 as the temperature increases in the reducible material with the hearth 20 moving the reducible material through the conversion zone 13 of the furnace.

In any case, the separation barrier 30 in each moving hearth 20 may be of a heat conductive material capable of conducting the heat generated in the combustion region 32 to the reducing region 31 to reduce the reducible material positioned on the moving hearth 20, or heat radiating material capable of absorbing heat form the combustion of the fluidized volatile material in the combustion region 32 and radiating heat into the reducing region 31 to reduce the reducible material, or both. As noted, each separation barrier 30 may be made of silicon carbide or other such higher heat conductive refractory material.

At the charging end 70 of each moving hearth 20, each removable hearth section or car 21 is charged by the charging system, typically with a first hearth layer of a finer carbon bearing material, such as coke, char, or coal, and then a second layer of a mixture of iron oxide and carbon bearing material. The mixture of the second layer may also comprise additives such as lime and fluorspar. The mixture of iron oxide and carbon bearing material may be comprised of preformed compacts, e.g., briquettes or compacts formed in situ on the hearth layer. An overlayer of a coarse carbon bearing material, such as coke, char or coal may also be provided over the second layer as described in application Ser. No. 60/820,366, filed Jul. 26, 2006, and incorporated herein by reference.

To provide for the flow of fluids in the combustion region 32 of the conversion zone 13, a first baffle 40 is provided between drying/preheat zone 12 and conversion zone 13 in each moving hearth 20. This first baffle 40 is capable of inhibiting direct fluid communication between the atmosphere of the conversion zone 13 and the atmosphere of the drying/preheat zone 12. First baffle 40 may be made of a suitable refractory material, such as silicon carbide, and may extend downwardly to within a few inches of the reducible material on the hearth 20. The design is to provide for efficient inhibiting of the direct fluids communication between the conversion zone 13 and the drying/preheat zone 12 in the furnace 10, without interfering with movement of reducible material on hearth 20 through furnace housing 11.

In each the moving hearth 20, first communication passageway 41 may be also provided and capable of carrying fluids from the combustion region 32 of the conversion zone 13 to the drying/preheat zone 12. The first communication passageway 41 may be a chamber or chambers laterally positioned in the side wall(s) 18 of the furnace housing 11 with a double refractory wall, or ducting which extends through the side wall(s) of the furnace housing 11.

The inlet 42 to first communication passageway 41 is located to provide for efficient combustion of the fluidized volatile material in combustion region 32, and to efficiently move the combusted fluids from the combustion region 32. The flow through first communication passageway 41 also is to facilitate flow of volatile fluids from the reducing region 31 to the combustion region 32 in each moving hearth 20, to provide flow of the fluidized volatile material within the reducing region 31 in the direction of travel of moving hearth 20 through the furnace housing 11, and to provide for flow of the fluidized volatile material and combusted fluids through the combustion region 32 counter to the direction of travel of said moving hearth 20 through the furnace housing 11 to facilitate flow from the outlet 43 of the first communication passageway 41. A damper (not shown) may also be provided in first communication passageway 41 so that the flow through drying/preheat zone 12 from outlet 43 can be coordinated with the flow through gas circulation system 100 between the drying/preheat zone 12 and the cooling zone 15 as described below. The damper in first communication passageway 41 may thus restrict flow to the drying/preheat zone 12, and may be provided with a diverter to an exhaust stack, if desired, or to a heat exchanger (not shown) for recovery of additional heat from the combusted fluids.

In each moving hearth 20 for efficient use of the transported fluids in the drying/preheat zone 12 and to provide for efficient heat transfer in drying/preheating the reducible material, a process fan 44 is provided with its inlet 45 adjacent the entrance baffle 19 of the reducible material on the hearth cars 21 into the furnace 10. The outlet 43 of first communication passageway 41 is provided adjacent the first baffle 40, and near the reducible material, to provide for efficient use of the fluid flow from passageway 41 in drying and preheating the reducible material in drying/preheat zone 12. To provide flow of the fluid through drying/preheat zone 12 counter to the movement of the hearth 20 through the furnace housing 11, a generally horizontal baffle 97 may extend from first baffle 40 into the drying/preheat zone 12 to direct flow of the fluid from outlet 43 of first communication passageway 41 through the drying/preheat zone 12, to efficiently transfer heat from the transported fluid to dry and preheat the reducible material on the moving hearth 20.

The temperature of the combusted fluids through first communication passageway 41 associated with each moving hearth 20 is generally too high for effective use of the drying/preheat zone 12. For this reason, a temperature controller 47 is positioned in first communication passageway 41 and is capable of controlling the temperature of the fluid flowing from the combustion region 32 of the conversion zone 13 to the drying/preheat zone 12. The temperature controller 47 may cool the fluid transported through first communication passageway 41 by mixing with a cooling gas such as tempering air or nitrogen transported from cooling zone 15. Alternatively, the temperature controller 47 may be in the form of a heat exchanger capable of controlling the temperature of the fluid flowing through first communication passageway 41 by extracting and recovering heat from the fluid flow in the first communication passageway 41. The extracted and recovered heat may be transferred to a secondary fluid in the heat exchanger 47 and transferred by a duct 48 to a heater (not shown) capable of heating gas supplied to the burners 16 in the combustion region 32 and the fusion zone 14, or the gas supplied to burners 16 may be heated directly in heat exchanger 47.

In each moving hearth 20, second baffle 50 is provided either between conversion zone 13 and fusion zone 14 or part way into fusion zone 14. Each second baffle 50 is capable of inhibiting direct fluid communication between the atmospheres of the part of the fusion zone 14 downstream of the baffle to the atmosphere of the conversion zone 13. Each second baffle 50 may be a refractory material, such as silicon carbide, and extend to within a few inches of the reducible material positioned on the hearth 20 as it moves through the furnace housing 11, to effectively inhibit the direct fluid communication across the second baffle 50.

Figure 7:
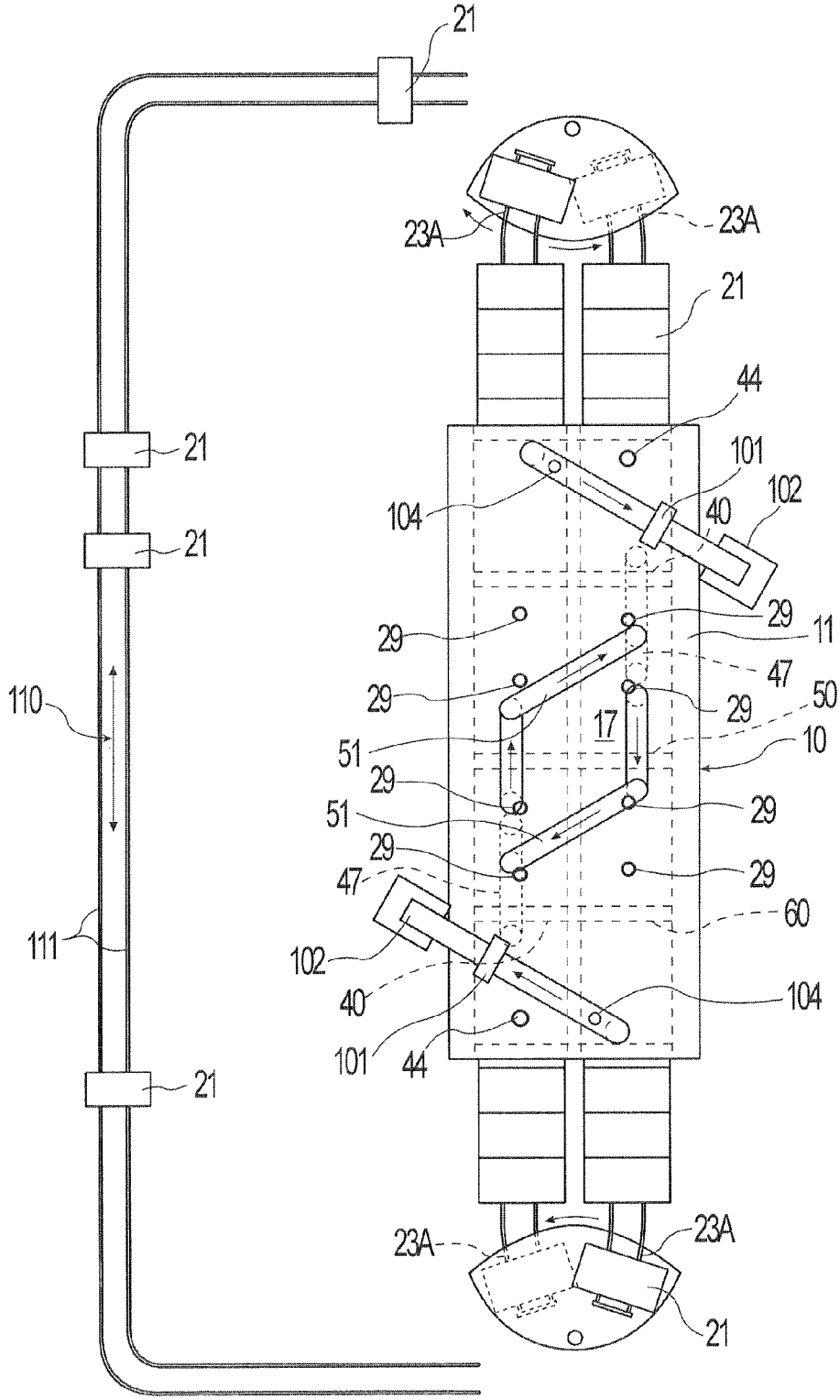
FIG. 7 is plan view illustrating a third embodiment of the multiple moving hearth furnace shown in FIG. 1.

With each moving hearth 20, a second communication passageway 51 is also provided capable of carrying fluid from the downstream part of the combustion region 32 of the conversion zone 13 and/or fusion zone 14 of the moving hearth 20 to the upstream part of the combustion region 32 of the conversion zone 13 adjacent the first baffle 40 of adjacent hearth 20 moving in the opposite direction. The interconnection of the passageway 51 between adjacent moving hearths 20 with the furnace housing 11 is shown in FIG. 7. The inlet 52 to second communication passageway 51 is positioned in fusion zone 14 downstream of second baffle 50 to provide flow of fluid through the fusion zone counter to the travel of the hearth 20 through fusion zone 14 to the combustion region 32 of the conversion zone 13 of a hearth 20 moving in the opposite direction. This provides for efficient transfer of the heat in reducing and melting of the metallic iron material in the fusion zone 14. For this purpose, a horizontal baffle 53 of refractory material may extend from second baffle 50 downstream into the fusion zone 14 to facilitate the counter current flow of fluid through the fusion zone and avoid turbulence in the vicinity of the reducible material as it passes under second baffle 50. The outlets 54 from second communication passageway 51 into the combustion region 32 of conversion zone 13 of the adjacent moving hearth 20 provide for efficient transfer of heat from the fluids in the fusion zone 14 to the combustion region 32 of the adjacent moving hearth 20, for their efficient use in combusting fluidized volatile material and produce heat assist in reducing the reducible material in the reducing region 31 of the adjacent moving hearth 20.

In each moving hearth 20, a cooling zone 15 is optional, since it may be desired in certain embodiments to perform the cooling of the metallic iron material outside the furnace housing 11 to reduce furnace costs and other considerations. Alternatively, a third baffle 60 may be provided between the fusion zone 14 and the cooling zone 15 of each moving hearth 20. Each third baffle 60 is capable of inhibiting direct fluid communication between the atmosphere of at least part of the cooling zone 15 and the atmosphere of the fusion zone 14. Each third baffle 60 may be made of a refractory material, such as silicon carbide, and may extend to within a few inches of the reducible material positioned on the moving hearth 20 as reducible material moves through each moving hearth 20. The third baffle 60 provides for efficient movement of fluid through the atmosphere of cooling zone 15 counter to the direction of travel of each moving hearth 20. Horizontal baffle 63 also of refractory material extends from third baffle 60 into cooling zone 15 to assist in inhibiting direct communication between the atmosphere of cooling zone 15 and the atmosphere of fusion zone 14, and to avoid turbulence in the vicinity of the material on the moving hearth cars 21 as they pass under the third baffle 60.

The exit end of the hearth furnace 10, at the cooling zone 15, is closed by a restricting baffle 65 that inhibits fluid flow between the outside ambient atmosphere and the atmosphere of the cooling zone 15, yet provides clearance so as not to inhibit the movement of reducible material out the furnace housing 11. The baffle 65 may be made of a suitable refractory material or a metal material if the temperatures are sufficiently low.

Heat insulating partition 92 is positioned between adjacent moving hearths 20 in at least portions of the conversion zones 13 at least partially separating the atmospheres adjacent opposite sides of the partition 92. Since there no partition between the adjacent moving hearths 20 in the drying/preheat zones 12 and the cooling zones 15, the heat extracted in the cooling zone 15 can be directly transferred to the drying/preheat zone 12 of the adjacent moving hearth 20. However, vertical baffles 93 of ceramic or other material, suitable for the temperatures involved, are positioned between the drying/preheat zones 12 and the cooling zones 15, with perforations 94 or like adjacent to curbs 24 to direct the flow of fluids from the cooling zone through the drying/preheat zone 12. Horizontal baffle 96 of refractory material extends from vertical baffle 65 into the cooling zone 15, and horizontal baffle 97 extends from first vertical baffle 40, to assist in directing flow adjacent the material on the moving hearths 20 through the cooling zone 15 and the drying/preheat zone 12.

Figure 4:
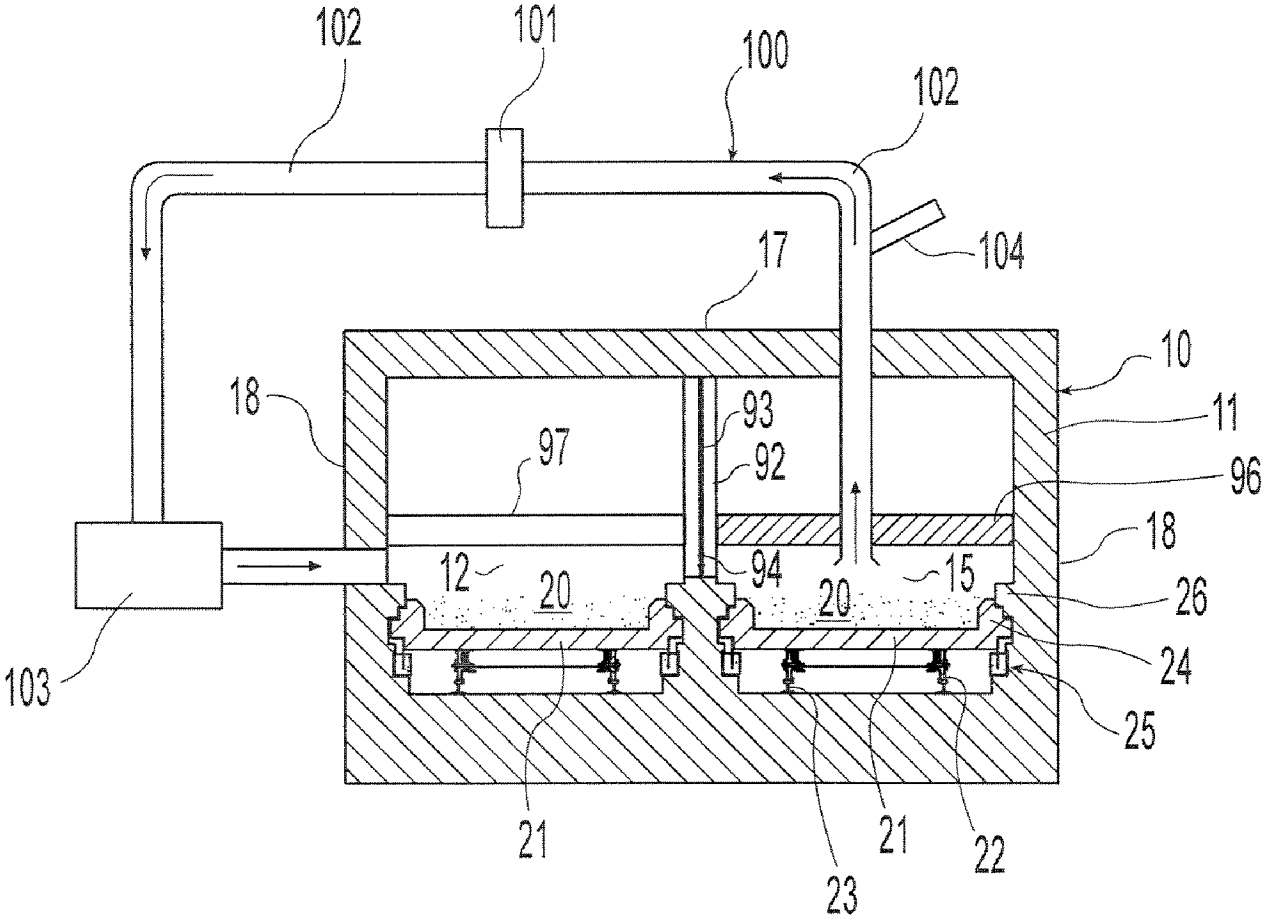
FIG. 4 is a cross-sectional view taken along line 4-4 of FIG. 2.

As shown in FIG. 4, the gas circulation system 100 transfers the heated gas from the cooling zone 15 of each moving hearth 20 to the drying/preheat zone 12 of the adjacent moving hearth 20, where the hot fluids dry and initially heat the reducible and carbon bearing materials on the removable hearth sections 21 to drive off residual moisture in the materials preheating those materials to about 260° C. (500° F.). Fan blower 103 recirculates the hot gas exiting the cooling zone 15 through conduit 102 and heat exchanger 101, where a cooling source, such as water or air (not shown) cools the hot gas. Cooled gas from heat exchange 101 is then circulated by blower-fan 103 through gas conduit 102 through inlet 105 to the drying/preheat zone 12, under horizontal baffle 97. From drying/preheat zone 12, the gas circulation system 100 circulates cooled gas into the cooling zone 15 through perforations 94 in vertical baffle 93, under horizontal baffle 96, to provide cold gas to cool the reduced iron nodules and related materials in the cooling zone 15 as shown in FIG. 4. As needed, nitrogen gas is added to the gas circulation system 100 through makeup conduit 104 to keep the gas circulation system 100 fully charged.

Inlet 105, horizontal baffles 96 and 97, and perforations 94 in vertical baffles 93 are positioned to provided for efficient circulation for drying and preheating the reducible material and associated carbon-bearing material on the moving hearth 20 in the drying/preheat zone 12 and for efficient cooling of the iron nodules and associated materials on the adjacent moving hearth 20 in the cooling zone 15. The circulation of gas by gas circulation system 100 through the drying/preheat zone 12 and the cooling zone 15 is also coordinated with flow of combusted and cooled gases from the combustion region 32 of conversion zone 13 through communication passageway 41 and heat exchanger 47, and exiting through fan 44, to provide for efficient drying and preheating in drying/preheat zone 12.

Each charging end 70 and discharging end 80 of each moving hearth 20 includes a hearth transfer system 90 such as turntable 91. After each removable hearth section 21 exits the discharging end 80 of a moving hearth 20, all or part of the contents of the removable hearth section 21 are removed by any suitable a discharge system at the discharge end 80, such as a conveyor. It may be beneficial to keep all or part of the hearth layer on the hearth section or car 21, to facilitate refilling the hearth section 21 for reentry into the adjacent moving hearth 20 of furnace 10. Next, the hearth sections 21 are decoupled, moved onto the turntable 91, the turntable 91 moved to orient the rails 23A to the rails 23 of the adjacent moving hearth 20, and the hearth section moved onto the rails 23 of the adjacent moving hearth 20 at the charging end 70. Note that this transfer by the hearth transfer system 90 can be done in groups of two or more hearth sections 21 depending on the capacity of the turntable 91. In any case, at the charging end 70 of the adjacent moving hearth 20 the hearth sections 21 are recoupled end-to-end with other hearth sections or cars 21, and a charging system, such as a conveyor refills the removable hearth sections or cars 21 with a at least one layer of the mixture of iron oxide and carbon bearing material and the overlayer of carbon bearing material as described above. The charging at the charging end 70 may involve filling the hearth section with a hearth layer first, if the hearth layer was not carried over from the previous discharge at the discharge end 80. In any case, the mixture of iron oxide source and carbon bearing material may in the form of preformed discrete pieces, such as briquettes or balls of iron oxide and carbon bearing material, or discrete portions or mounds formed in situ.

The hearth transfer system 90 includes turntable 91 having sections of rails 23A, which can match to rails 23 connecting to either the discharging end 80 of one moving hearth 20 or the charging end 70 of an adjacent moving hearth 20. The turntable 91 may be separately driven to move the heath sections or cars 21 into position with the rails 23A under the hearth cars matching the rails 23 of one moving hearth 20 being serviced. As is apparent for the design of turntable 91, more than two moving hearths 20 through the furnace housing 11 of furnace 10 can be serviced at the hearth transfer system 90 at either end of the furnace housing 11.

As shown in FIG. 7, a hearth maintenance system 110 may also be provided to permit removal of removable hearth sections 21 from the moving hearth 20 for maintenance or repair. The hearth maintenance system 110 comprises sections of rails 111 that can connect to the hearth transfer systems 90 through turntable 91 at the charging end 70 and the discharging end 80 of each moving hearth 20. Thus, any removable hearth section 21 can be removed from the hearth transfer system 90, as desired, at either end of the multiple hearth movable hearth furnace 10 and transferred to the hearth maintenance system 110. In addition, a removable hearth section 21 can be transferred from the hearth maintenance system 110 to the hearth transfer systems 90 at either charging end 70 or the discharging end 80 of the multiple hearth movable hearth furnace 10. The hearth maintenance system 110 allows removable hearth sections 22 to be removed from the moving hearths 20 and to be reintroduced to the moving hearths 20 without interrupting the operation of the moving hearth furnace 10.

Figure 5:
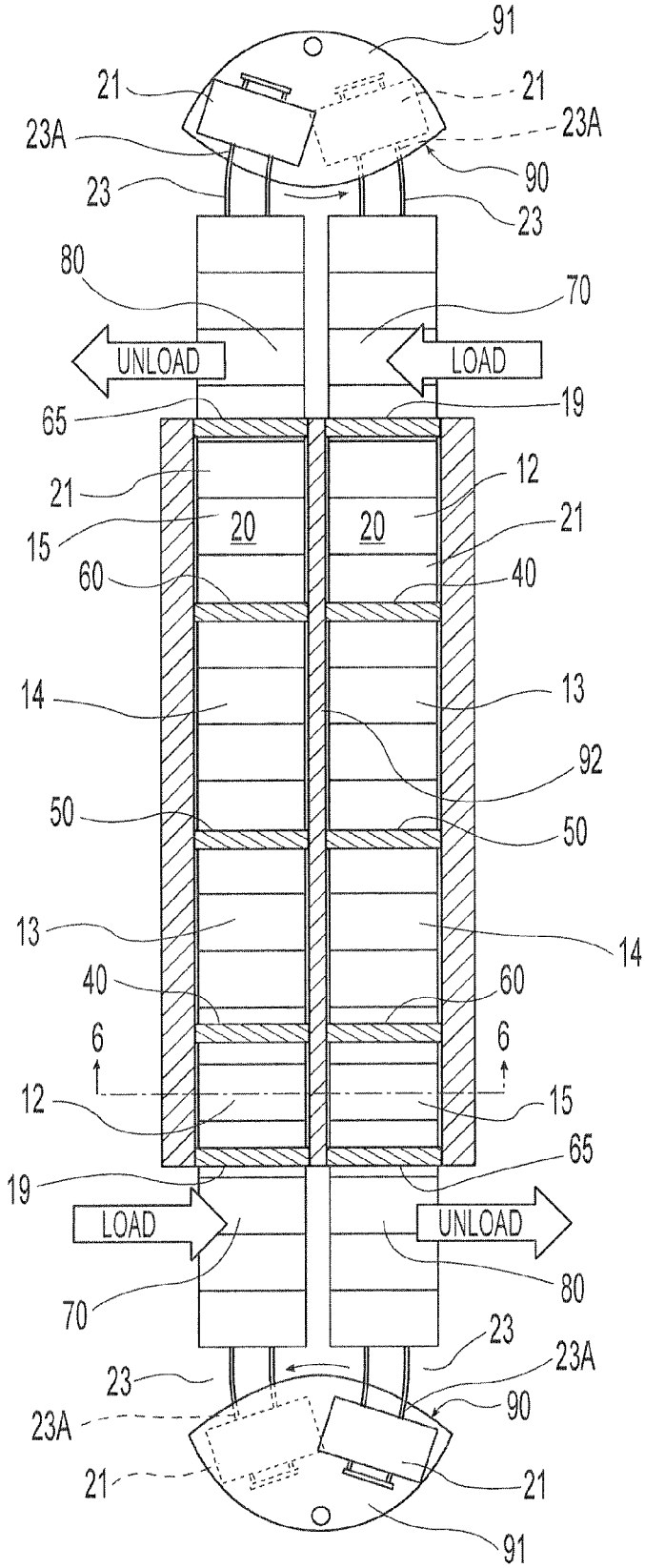
FIG. 5 is plan view illustrating a second embodiment of the multiple moving hearth furnace taken along line 2-2 of FIG. 1 with horizontal baffles not shown for clarity.

In an alternate embodiment, shown in FIG. 5, the heat insulating partition 92, extends between the drying/preheat zone 12 of one moving hearth 20 and the cooling zone 15 of the adjacent moving hearth 20. In this embodiment, the hot inert gas flows from the cooling zone 15 to the adjacent drying/preheat zone 12 due to a pressure drop induced by fan-blower 103. With this embodiment, as shown in FIG. 6, the cooling zone 15 of one moving hearth 20 is interconnected with the drying/preheat zone 12 of an adjacent moving hearth 20 by conduit 95, such that the residual heat in the hot materials on the removable hearth sections 21 existing the fusion zone 14 may be used to dry and preheat the just charged materials in the removable hearth sections 21 of the adjacent moving hearth 20.

Figure 6:
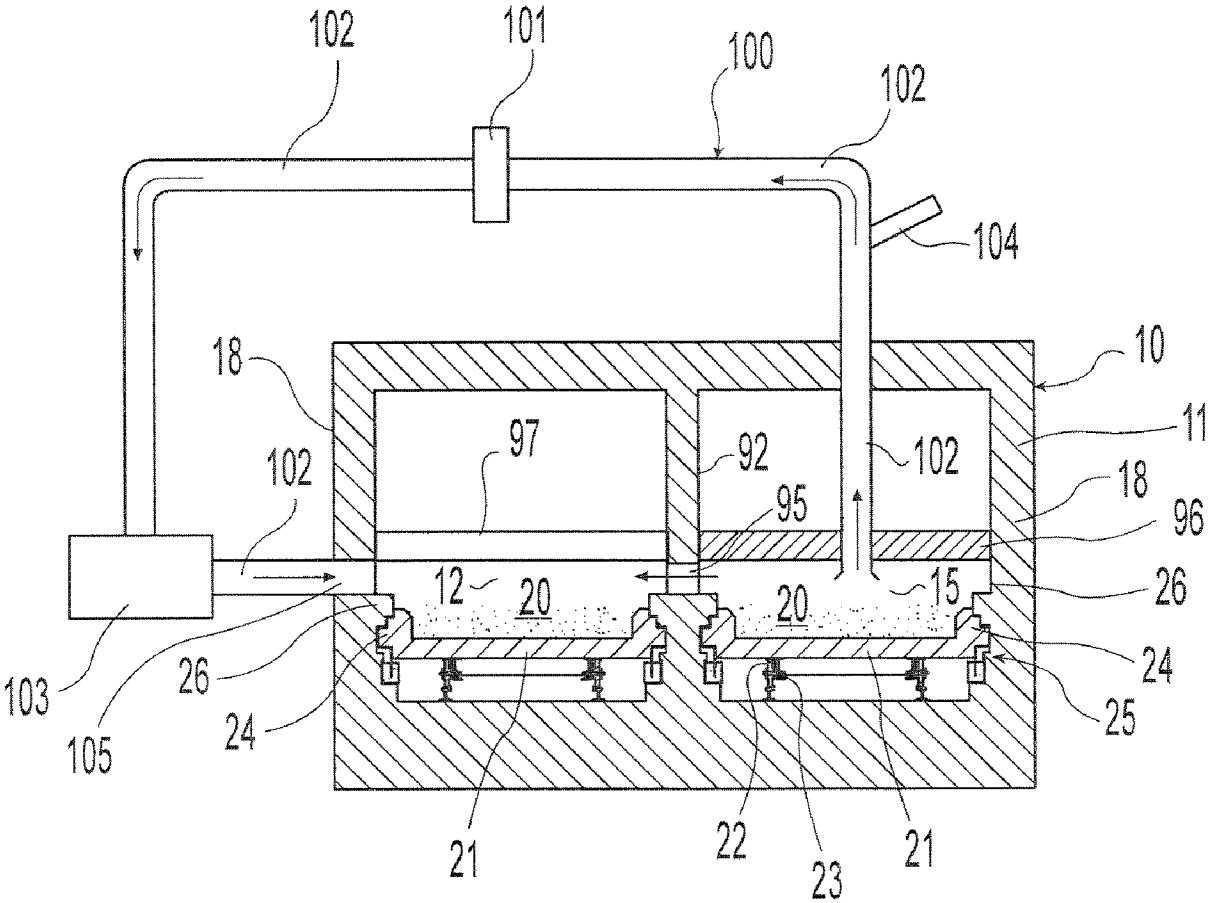
FIG. 6 is a cross sectional view taken along line 6-6 of FIG. 5.

Referring to FIG. 6, the gas circulation system 100 is again provided to circulate the atmosphere from the cooling zone 15 of the moving hearth 20 to the drying/preheat zone 12 of the adjacent moving hearth 20. Gas circulation system 100 may be filled with an inert gas, such as nitrogen, which is recirculated by a fan-blower 103. Because of the high temperature of the removable hearth sections 21 and the hot materials thereon, the non-oxidizing nitrogen atmosphere inhibits, if not eliminates re-oxidation of the reduced iron nodules and ignition of the remaining carbon bearing materials.

As previously explained, the charging system (not shown) at charging end 70 may be operated to refill each moving hearth car 21 with a layer of fine carbon bearing material, such as char or coal on each removable hearth section 21, then at least one layer of mixed iron oxide and carbon bearing material on the hearth layer and then an overlayer of coarse carbon bearing material, such as char or coal. After the materials are placed on each removable hearth section or car 21, the removable hearth sections 21 are pushed into and through moving hearth 20 by pushers (not shown). In one embodiment, reciprocal hydraulic cylinders may be provided that are coordinated such that while one cylinder is extending and pushing on one removable hearth section 21 into a moving hearth 20, the other cylinder is retracting to a starting position to be ready to push the next removable hearth section 21 into the same moving hearth 20. As a result, by coordinated motion of the cylinders, the removable hearth sections 21 are continually moved through each moving hearth 20.

Upon exiting the cooling zone 15, the removable hearth sections 21 enter the discharge system at discharging end 80. The removed material may be transferred to a classifier system (not shown) that classifies the removed material by at least one of size, weight and density into reduced iron nodules, coarse carbon bearing material (e.g., +6 mesh), slag, and fine carbon bearing material (e.g., −6 mesh). The classified carbon bearing material is transferred back for re-use by the charging system at charging end 70 for the hearth layer or overlayer charged on the removable hearth section 21. The reduced iron nodules are removed as final product, and the slag may be removed as a waste product.

It is seen from the description of the detailed embodiments that the present invention provides a multiple moving hearth furnace that has a higher production capacity, is more efficient in transferring fluids between different parts of the furnace, and has a lower capital and operating cost for a given production capacity. Specifically, the production capacity of the furnace 10 is at least twice the capacity of a moving hearth furnace have only one moving hearth. Fluids can be rapidly and efficiently transferred between different points in the conversion zone 13 and fusion zone 14 of adjacent moving hearths, moving in opposite directions, with minimum heat lose in the transfer. Further, the heat generated in the cooling zone 15, in cooling the material after the reduction, can be directly used in drying/preheating charged reducible material and carbon bearing materials in the drying/preheat zone 12 of an adjacent moving hearth. Also, the residual heat in the removable hearth sections or cars 21, after discharge at the discharge end 80, can be efficiently used in the reduction operation of the furnace 10 since the hearth sections or cars can be immediate reloaded and returned to operation in the furnace in the adjacent moving hearth 20. Finally, the capital and operating costs for a given production capacity are substantially reduced since only one furnace housing 11 and hearth furnace 10 needs to be built and maintained. The invention may thus be practiced in other embodiments within the scope of the following claims.

Having described the invention, what is claimed is:

1. A method of reducing an iron oxide source in a multiple moving hearth furnace comprising the steps of:

a. providing a furnace housing having at least two moving hearths positioned laterally within the furnace housing, at least two of said hearths moving in opposite directions and each moving hearth capable of being charged with at least one layer of iron oxide source and carbon bearing material adjacent one end of the furnace housing, and being capable of discharging reduced material adjacent the other end of the furnace housing, b. positioning a heat insulating partition between adjacent moving hearths in at least portions of conversion zones at least partially separating the atmospheres adjacent opposite sides of the partition, c. charging removable hearth sections of each moving hearth with at least a layer of iron oxide and carbon bearing material, d. passing each moving hearth within the furnace housing sequentially through a drying/preheat zone providing an atmosphere capable of drying an iron oxide source and carbon bearing material, the conversion zone providing an atmosphere capable of fluidizing volatile material in the iron oxide source and at least partially reducing iron oxide, and, optionally, a cooling zone capable of providing a cooling atmosphere for cooling reduced material containing metallic iron on the moving hearth positioned within the furnace housing, and e. transferring fluid between the atmospheres of the conversion zones of moving hearths moving in opposite directions within the furnace housing.

2. The method of reducing an iron oxide source in a multiple moving hearth furnace as claimed in claim 1 further comprising the step of:

combusting the transferred fluidized volatiles within the conversion zone of a moving hearth moving in the opposite direction within the furnace housing to heat the iron oxide source and carbon bearing material on removable hearth sections moving through the conversion zone.

3. The method of reducing an iron oxide source in a multiple moving hearth furnace as claimed in claim 1 further comprising the step of:

transferring fluids between the atmospheres of the adjacent drying/preheating and cooling zones.

4. The method of reducing an iron oxide source in a multiple moving hearth furnace as claimed in claim 1 where the heat insulating partition extends to between the drying/preheating zones and cooling zones of adjacent moving hearth moving in opposite directions through the furnace.

5. The method of reducing an iron oxide source in a multiple moving hearth furnace as claimed in claim 4 further comprising:

a. providing a transfer system capable of transferring fluids between the atmospheres of the adjacent drying/preheating and cooling zones.

6. The method of reducing an iron oxide source in a multiple moving hearth furnace as claimed in claim 1 where the charging end of one moving hearth is adjacent to the discharging end of an adjacent moving hearth.

7. The method of reducing an iron oxide source in a multiple moving hearth furnace as claimed in claim 6 where the circulation system is a closed loop system and comprises an inert gas.

8. The method of reducing an iron oxide source in a multiple moving hearth furnace as claimed in claim 1 further comprising:

providing a circulation system capable of circulating fluids between the atmospheres of the cooling zones and the drying/preheat zones of adjacent moving hearth.

9. The method of reducing an iron oxide source in a multiple moving hearth furnace as claimed in claim 1 further comprising the conversion zone of each moving hearth having at least a devolatilization zone and a reduction zone sequentially positioned along each moving hearth, and the step of transferring fluid between the atmospheres of the conversion zones of moving hearths moving in opposite directions comprises transferring fluid from the atmosphere of the devolatilization zone of one moving hearth to the atmosphere of the reduction zone of the other moving hearth.

10. The method of reducing an iron oxide source in a multiple moving hearth furnace as claimed in claim 1 where each moving hearth comprises a plurality of removable hearth sections, and further providing a transfer mechanism capable of moving removable hearth sections from the discharging end of each moving hearth to the charging end of another moving hearth within the furnace.

11. The method of reducing an iron oxide source in a multiple moving hearth furnace as claimed in claim 1 where each moving hearth comprises a plurality of removable hearth sections, and further comprising providing a maintenance apparatus capable of receiving removable hearth sections from either end of said at least two moving hearths in the furnace and capable of returning removable hearth sections to any one of said at least two moving hearths.

12. A multiple moving hearth furnace comprised of:

a. a furnace housing having at least two moving hearths positioned laterally within the furnace housing, at least two of said hearths moving in opposite directions and each moving hearth capable of being charged with at least one layer of iron oxide source and carbon bearing material adjacent one end of the furnace housing, and being capable of discharging reduced material adjacent the other end of the furnace housing, b. each moving hearth capable of passing within the furnace housing sequentially through a drying/preheat zone providing an atmosphere capable of drying an iron oxide source and carbon bearing material, a conversion zone providing an atmosphere capable of fluidizing volatile material in the iron oxide source and at least partially reducing iron oxide, and, optionally, a cooling zone capable of providing a cooling atmosphere for cooling reduced material containing metallic iron on the moving hearth positioned within the furnace housing, and c. a heat insulating partition positioned between adjacent moving hearths in at least portions of the conversion zones at least partially separating the atmospheres adjacent opposite sides of the partition, d. at least one communication passageway capable of transferring fluid between the atmospheres of the conversion zones of moving hearths moving in opposite directions within the furnace housing.

13. The multiple moving hearth furnace as claimed in claim 12 comprising a transfer system capable of transferring fluids between the atmospheres of the adjacent drying/preheating and cooling zones.

14. The multiple moving hearth furnace as claimed in claim 12 where the heat insulating partition extends to between the drying/preheating zones and cooling zones of adjacent moving hearth moving in opposite directions through the furnace.

15. The multiple moving hearth furnace as claimed in claim 14 comprising a transfer system capable of transferring fluids between the atmospheres of the adjacent drying/preheating and cooling zones.

16. The multiple moving hearth furnace as claimed in claim 12 where the charging end of one moving hearth is adjacent to the discharging end of an adjacent moving hearth.

17. The multiple moving hearth furnace as claimed in claim 12 further comprising a circulation system capable of circulating fluids between the atmospheres of the cooling zones and the drying/preheat zones of adjacent moving hearths.

18. The multiple moving hearth furnace as claimed in claim 17 where the circulation system is a closed loop system and comprises an inert gas.

19. The multiple moving hearth furnace as claimed in claim 12 further comprising the conversion zone of each moving hearth having at least a devolatilization zone and a reduction zone sequentially positioned along each moving hearth, and the at least one communication passageway capable of communicating fluid from the atmosphere of the devolatilization zone of each moving hearth to the atmosphere of the reduction zone of an adjacent moving hearth.

20. The multiple moving hearth furnace as claimed in claim 12 where each moving hearth comprises a plurality of removable hearth sections, and further comprising a transfer mechanism capable of moving removable hearth sections from the discharging end of each moving hearth to the charging end of another moving hearth within the furnace.

21. The multiple moving hearth furnace as claimed in claim 12 where each moving hearth comprises a plurality of removable hearth sections, and further comprising a maintenance apparatus capable of receiving removable hearth sections from either end of said at least two moving hearths in the furnace and capable of returning removable hearth sections to any one of said at least two moving hearths.

22. The multiple moving hearth furnace as claimed in claim 12 further comprising a drive system capable of causing each moving hearth to move through the furnace housing from the charging end to the discharging end.

* * * * *

UNITED STATES PATENT AND TRADEMARK OFFICE

CERTIFICATE OF CORRECTION

PATENT NO. : 8,133,299 B2
APPLICATION NO. : 12/513872
DATED : March 13, 2012
INVENTOR(S) : Mark M. Brandon and Bradford G. True It is certified that error appears in the above-identified patent and that said Letters Patent is hereby corrected as shown below:

IN THE SPECIFICATION:

Column 1, lines 20-21, “may have” should read --has--.

Signed and Sealed this
Fifth Day of June, 2012

David J. Kappos

David J. Kappos
*Director of the United States Patent and Trademark Office*

UNITED STATES PATENT AND TRADEMARK OFFICE

CERTIFICATE OF CORRECTION

PATENT NO. : 8,133,299 B2
APPLICATION NO. : 12/513872
DATED : March 13, 2012
INVENTOR(S) : Mark Brandon and Bradford True It is certified that error appears in the above-identified patent and that said Letters Patent is hereby corrected as shown below:

In the Specification:
Column 1, lines 17-21
delete "The present invention was made with support by the Economic Development Administration, Grant No. 06-69-04501, and the Department of Energy, Sponsor Award DE-FG36-05G015185. The United States government may have certain rights in the invention."
insert -- This invention was made with government support under Sponsor Award DE-FG36-05GO15185 awarded by the Department of Energy, and Grant No. 06-69-04501 awarded by the Economic Development Administration. The government has certain rights in the invention. --

Signed and Sealed this
Tenth Day of June, 2014

Michelle K. Lee

Michelle K. Lee
*Deputy Director of the United States Patent and Trademark Office*